United States Patent [19]

Platner et al.

[11] 3,964,789

[45] June 22, 1976

[54] CHAIR

[75] Inventors: Warren Platner, New Haven, Conn.; Earl G. Ursul; Stephen B. Kolk, both of Grand Rapids, Mich.; Ronald L. Whitwam, Caledonia, Mich.

[73] Assignee: Steelcase, Inc., Grand Rapids, Mich.

[22] Filed: July 12, 1974

[21] Appl. No.: 488,054

Related U.S. Application Data

[62] Division of Ser. No. 344,851, March 26, 1973, Pat. No. 3,841,704.

[52] U.S. Cl. ..... 297/445; 108/150

[51] Int. Cl.[2] ..... A47C 7/00

[58] Field of Search ..... 297/445, 448, 458, 219, 297/218, 229, 349, DIG. 2; 108/150, 151

[56] References Cited

UNITED STATES PATENTS

| | | | |
|---|---|---|---|
| 659,251 | 10/1900 | Nerad | 297/218 |
| 1,425,582 | 8/1922 | Feigler | 108/150 |
| 1,704,346 | 3/1929 | Schneider | 297/219 |
| 2,159,098 | 5/1939 | Morgan | 297/445 X |
| 2,170,224 | 8/1939 | Tarr | 297/218 |
| 3,065,991 | 11/1962 | Finucane | 297/229 |
| 3,124,390 | 3/1964 | Eames | 297/458 |
| 3,300,251 | 1/1967 | Helms | 297/DIG. 2 |
| 3,521,929 | 7/1970 | Pearson | 297/458 |
| 3,626,871 | 12/1971 | McClendon | 108/151 |
| 3,747,978 | 7/1973 | Barecki | 297/445 |
| 3,758,159 | 9/1973 | Morris | 297/458 |
| 3,797,885 | 3/1974 | Harman | 297/445 |

*Primary Examiner*—Francis K. Zugel

*Attorney, Agent, or Firm*—Price, Heneveld, Huizenga & Cooper

[57] ABSTRACT

The specification discloses a contoured, molded plastic shell chair whose exterior shell is segmented into arm, back and seat shell segments so that, while each segment is contoured somewhat, each segment is free of any sharp contours. Each segment is separately upholstered by an unseamed upholstery segment. The chair body is supported on a base secured in a recess in the bottom of the seat segment of the chair shell. The upper portions of the base are hidden by a plastic cover secured to the bottom of the chair. The cover includes an aperture through which the supporting post of the base passes and preferably a slot from the aperture to the cover periphery so that the slightly flexible cover can be opened and slipped around the supporting post of the base.

4 Claims, 19 Drawing Figures

CHAIR

CROSS REFERENCE TO RELATED APPLICATION

This is a division of application Ser. No. 344,851, filed Mar. 26, 1973 and entitled CHAIR, now U.S. Pat. No. 3,841,704.

BACKGROUND OF THE INVENTION

The present invention relates to contoured, plastic shell chairs. Plastic shell chairs are popular because of the attractive contours which can be molded into the exterior supporting shell. The plastic not only fulfills the structural requirements of the chair, but also provides an attractive exterior surface. Generally, the shells are somewhat difficult to upholster since the contours which are usually designed into such shells are extremely difficult to cover with upholstery.

Chairs having upholstered exteriors employ simple, boxy straight lines and an upholstering envelope. The envelope includes seams along the sharp contour lines which generally exist between the back and the arms and the seat, arms and back. In fact, most manufacturers do not even attempt to upholster the bottom surface of the chair. It would be very difficult to sew an upholstery envelope for a chair having a contoured, as opposed to a straight line appearance.

Some attempt to overcome this difficulty by designing chairs with very straight backs and with separate arms. The back and the arms are upholstered separately and then joined together. However, no effort is made to upholster the bottom of the chair. Further, this approach has the drawback of enabling one to design a chair having only a conventional, box-like appearance, rather than a striking, contoured appearance. Yet, another problem with such chairs is that the means for interconnecting the arms to the rest of the chair are generally clumsy. Indeed, chairs having separate exterior shell components suffer from the fact that the edges of the joined components are left exposed and visible. In each cases, a special trim piece must be used.

Another problem encountered in the manufacture of contoured plastic shell chairs is one relating to the manner in which cushions are to be supported in the shell. The shell does not provide any framework to which such cushions can readily be attached. Gluing is sometimes utilized, but this is a time consuming operation in view of the need to carefully locate each of the separate cushions as it is adhered to the shell.

These related problems tend to restrict the chair designer, both in giving the chair the contoured lines which he desires and in selecting the plastic material from which the contoured shell is to be made.

SUMMARY OF THE INVENTION

The present invention is a molded plastic shell chair whose exterior shell can be both artistically contoured and completely upholstered. Upholstery envelopes and sewn seams are completely eliminated. Further, the manner in which the cushions are assembled to the exterior shell is quick, convenient and positive.

One aspect of this invention which is extremely advantageous is the provision of a plastic cover, molded or otherwise cut to a desired design configuration and secured to the bottom of the chair body for covering the upper portions of the supporting base which supports the chair body. The cover has an aperture therein through which the supporting post of the supporting base extends.

Preferably, the cover includes a slot extending from the edge of the aperture to the periphery of the cover, the cover being sufficiently flexible, even though holding desired molded design configuration to be spread apart at the slot at a sufficient distance to allow the cover to be slipped around the supporting post of the base during assembly of the chair. Also preferably, the chair body has a recess in the bottom therein into which the upper portions of the base extend. The cover then has an upturned perimeter conforming generally to the shape of the recess whereby the upturned perimeter of the cover is positioned within the recess.

These and other features, objects and advantages of the invention will be more fully understood and appreciated by reference to the written specification and appended drawings.

DESCRIPTION OF THE PREFERRED EMBODIMENT

Figure 1:
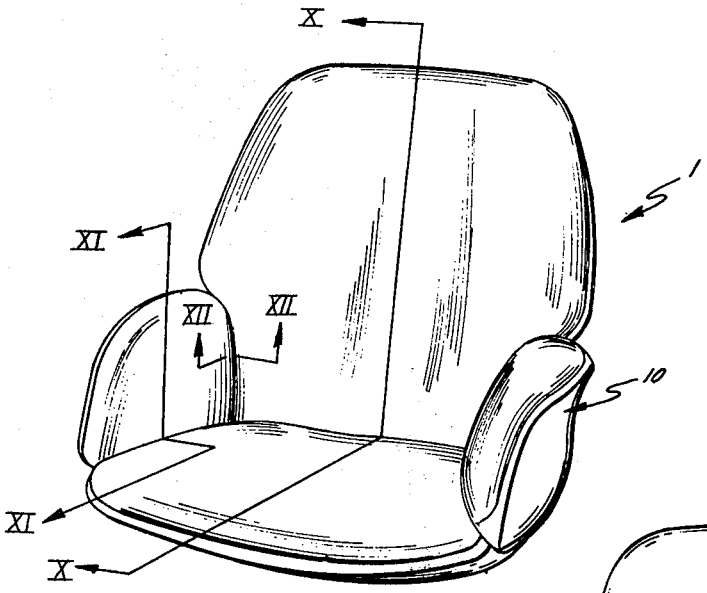
FIG. 1 is a perspective view of a contoured, plastic shell chair body made in accordance with the present invention.
Figure 2:
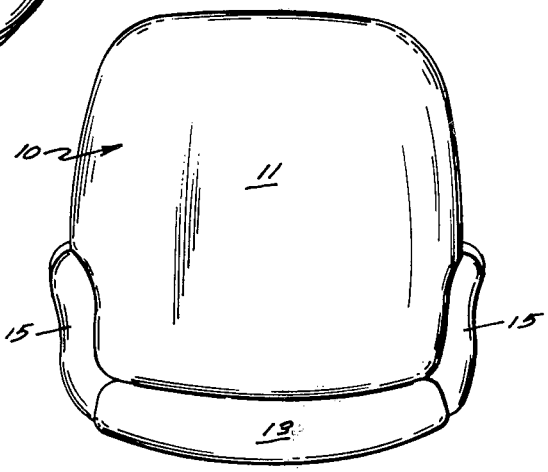
FIG. 2 is a rear elevation of the chair body.
Figure 3:
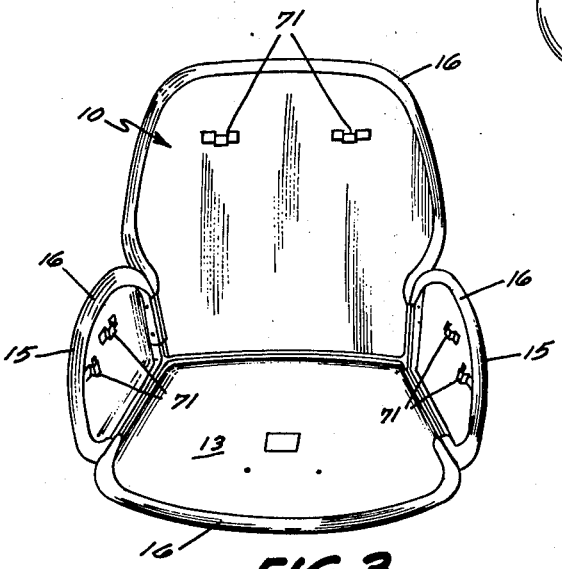
FIG. 3 is a front perspective view of the assembled shell for the chair body.

In the preferred embodiment, the contoured, exterior shell 10 of chair 1 is segmented along its lines of sharpest contour into a separate back segment 11, seat segment 13 arm segment 15 (FIGS. 1, 2 and 3). While each of these segments is somewhat contoured to conform to a desired aesthetic appearance, there are no sharp contours in any given shell segment. Each of these segments is upholstered and then joined together by suitable fastening means such as nuts and bolts 30.

Figure 8:
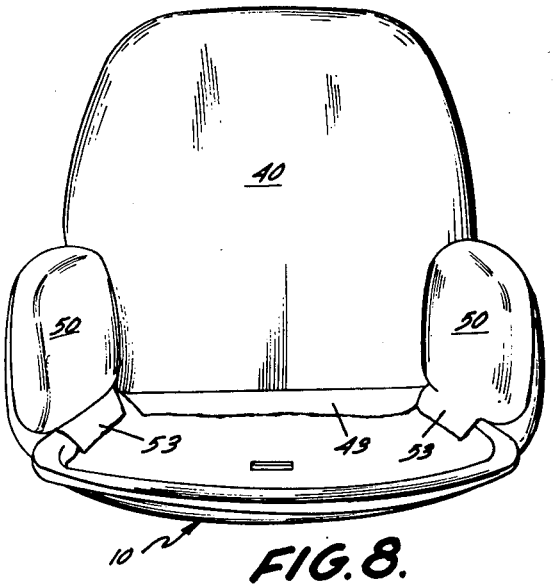
FIG. 8 is a front perspective view of the chair shell with the back and arm cushions in place.
Figure 9:
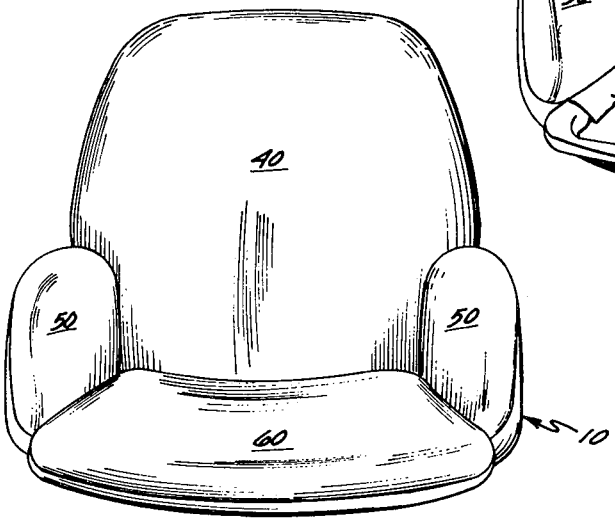
FIG. 9 is a front perspective view of the chair body with all of the cushions in place.
Figure 19:
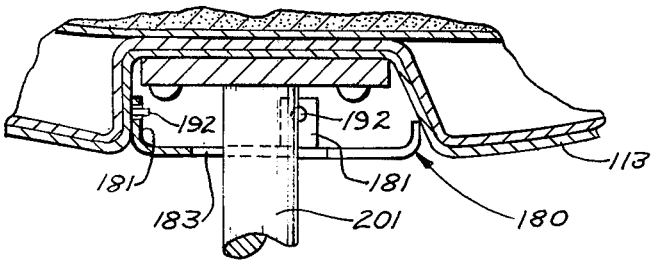
FIG. 19 is a cross-sectional view taken generally along the plane XIX—XIX of FIG. 16.
Figure 10:
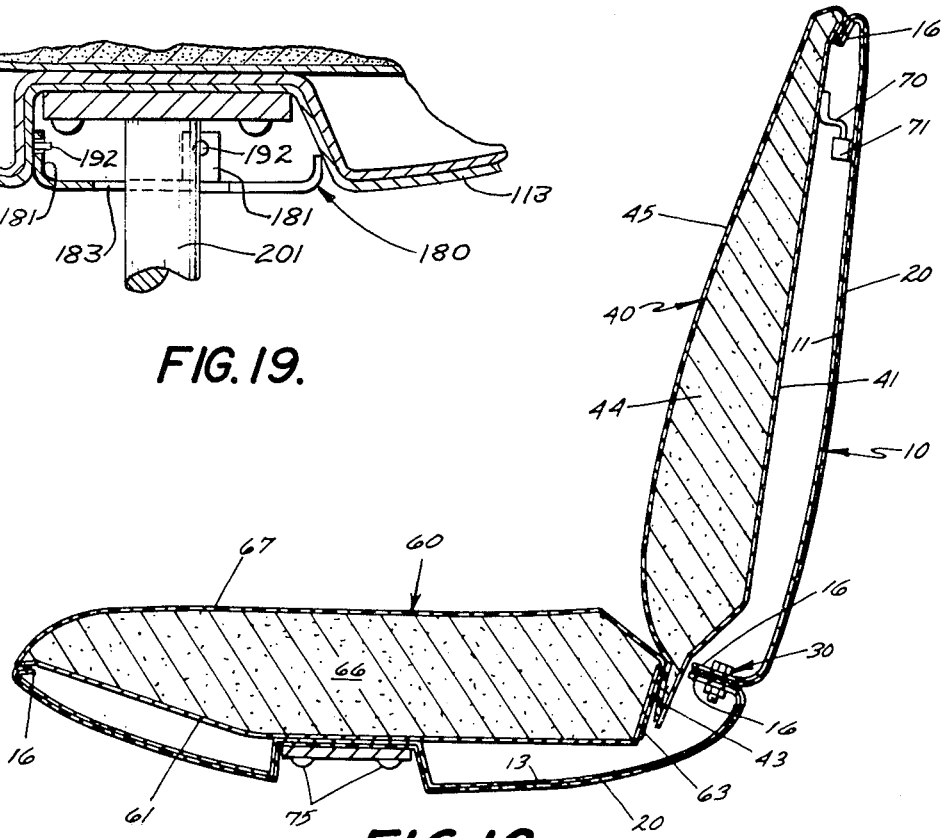
FIG. 10 is a cross-sectional view taken along plane X—X of FIG. 1.
Figure 11:
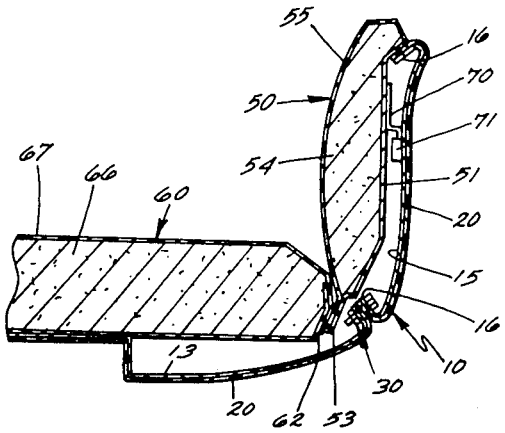
FIG. 11 is a cross-sectional view taken along plane XI—XI of FIG. 1.
Figure 12:
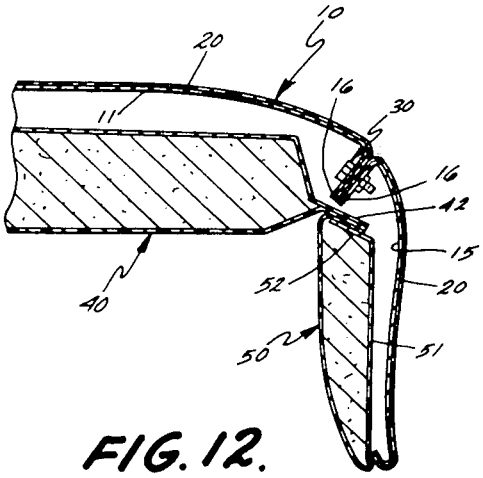
FIG. 12 is a cross-sectional view taken along plane XII—XII of FIG. 1.

A back cushion 40 and a pair of arm cushions 50 are hung by hooks 70 in hanger 71 which are secured to the exterior supporting shell 10 (FIGS. 8, 9, 10 and 11). Back cushion 40 includes a bottom flange 43 which sits generally beneath bottom cushion 60 and side flanges 42 which fit behind arm cushions 50 (FIGS. 10, 11 and 12). Each arm cushion 50 includes a bottom flange 53 which fits beneath seat cushion 60. Thus, when seat cushion 60 is bolted in place by bottom bolts 75, back cushions 40 and arm cushions are basically locked in position and are rendered substantially unremovable.

The back segment 11, seat segment 13 and arm segments 15 of exterior supporting shell 10 are molded of a glass fiber reinforced polyester resin. Each segment is contoured to conform to the overall aesthetic design which is desired. Naturally, this can be varied substantially to suit a particular designer's tastes. Similarly, the lines of demarcation between connected shell segments can be made either very pronounced or can be made to appear very fine and seam-like. In the embodiment shown in the drawings, the lines of demarcation between the adjacent segments have been made very pronounced in order to achieve a particular aesthetic effect.

Each segment, while contoured somewhat, is free of any sharp contours therein. This makes it possible to cover the exterior surface of each shell segment with a single piece of unseamed upholstery 20 FIGS. 10, 11 and 12). In the preferred embodiment, there are four separate shell segments. If, however, a designer wanted to particularly sharp contour in the middle of the seat segment, the seat segment could be divided into two separate segments.

Each of the shell segments include an inwardly turned flange 16 extending around the periphery thereof (FIGS. 3, 10, 11 and 12). When the various shell segments are placed adjacent one another, portions of these flanges 16 abut. The shells are secured together by a plurality of nut and bolt combinations 30, the bolts passing through apertures in the abutting flange portions. Upholstery 20 can be selected to suit a desired aesthetic effect. Upholstery 20 is secured to the exterior of each shell segment by gluing.

Figure 4:
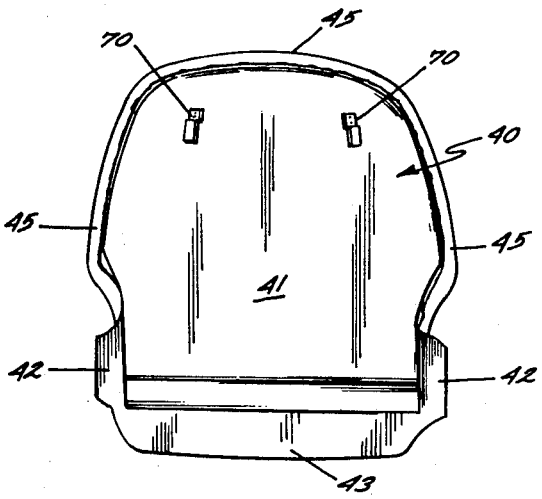
FIG. 4 is a rear elevational view of the back cushsion of the chair.

Back cushion 40, which is secured to back shell segment 11, comprises a molded plastic pan 41 to which is adhered a foam cushion 44 (FIGS. 4 and 10). A piece of upholstery 45 covers foam cushion 44 and wraps generally around the peripheral edges of pan 41 and is secured on the back side thereof.

Pan 41 is molded of glass fiber reinforced polyester resin and includes a pair of side flanges 42 projecting either side thereof, at the bottom thereof and being formed integrally therewith. Similarly, a bottom flange 43 is formed integrally with pan 41 and projects downwardly from the bottom thereof. Bottom flange 43 slopes forwardly at an angle and seats in beneath seat cushion 60 (FIG. 10). Side flanges 42 similarly slope forwardly at an angle and fit in behind arm cushions 50 (FIG. 2). Arm cushions 50 and seat cushions 60 thus cooperate with side flanges 42 and bottom flange 43, respectively, to aid in positively holding back cushion 40 in place. Since flanges 42 and 43 are hidden, upholstery 45 is secured to the face thereof and does not have to be wrapped there around.

Back cushion 40 is held in place at its top by a pair of hooks 70 which are secured to pan 41 and which hook into receiving hangers 71 (FIGS. 3, 4 and 10). Hangers 71 are secured to back segment 11. The hooks 70 hook downwardly so that back cushion 40 is assembled by sliding it downwardly. It is held against back segment 11 in this manner, but readily removable by moving it upwardly. It is the cooperation of seat cushion 60 and bottom flange 43 which prevents such upward movement in the finally assembled chair.

Figure 5:
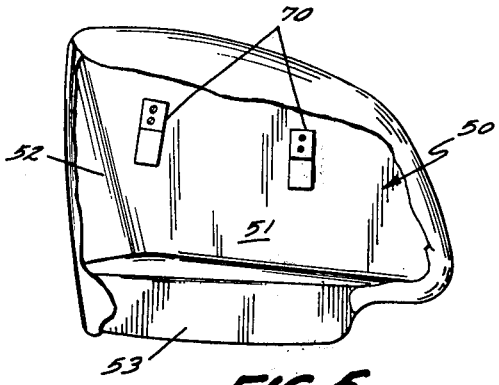
FIG. 5 is a rear elevational view of the arm cushion of the chair.

The construction of each arm cushion 50 is similar (FIGS. 5, 11 and 12). Each arm cushion 50 includes a molded plastic pan 51 molded of glass fiber reinforced polyester resin. Pan 51 includes a forwardly sloping sidewall 52 which matingly abuts a side flange 42 of back cushion 40. It also includes a downwardly and inwardly projecting bottom flange 53 which seats beneath bottom cushion 60.

Pan 51 includes a pair of hooks 70 thereon which hook downwardly into receiving hangers 71 which are mounted on the inside of arm segments 15 of shell 10 (FIGS. 3 and 11). As with back cushion 40, arm cushions 50 are initially positioned by sliding them downwardly into hooks 71 and are readily removable upwardly except for the interaction of their bottom flanges 53 and seat cushion 60.

A suitable foam cushion material 54 is adhered to the surface of pan 51 is covered by upholstery 55 which wraps generally around the edges of pan 51 and is secured therebehind. At flange 53, the upholstery merely goes down the surface thereof and is adhered thereto.

Figure 6:
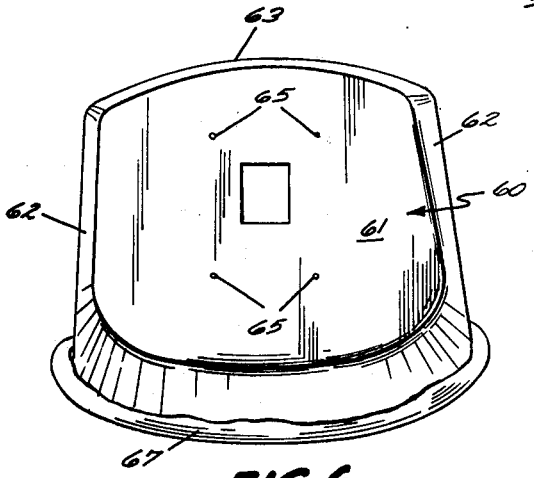
FIG. 6 is a bottom plan view of the bottom cushion for the chair.

Bottom cushion 60 is also similarly constructed, including a molded plastic pan 61, a foam cushion 66 adhered thereto and upholstering 67 covering foam cushion 66 and wrapping around pan 61 (FIGS. 6, 10 and 12). The rear wall 63 and side walls 62 of pan 61 slope downwardly and inwardly generally to the same degree as bottom flange 43 of back cushion 40 and bottom flange 53 of arm cushions 50, respectively. In this manner, back wall 63 matingly abuts bottom flange 43 to positively lock that cushion 40 in position and side walls 62 matingly abut bottom flanges 53 to positively lock arm cushions 50 in position. The bottom of pan 61 includes several threaded apertures 65 therein which receive bottom bolts 75 to positively secure seat cushion 60 to seat shell segment 13 (FIGS. 6 and 10). A suitable aperture 68 is provided in the bottom of pan 61 for venting purposes.

Figure 7:
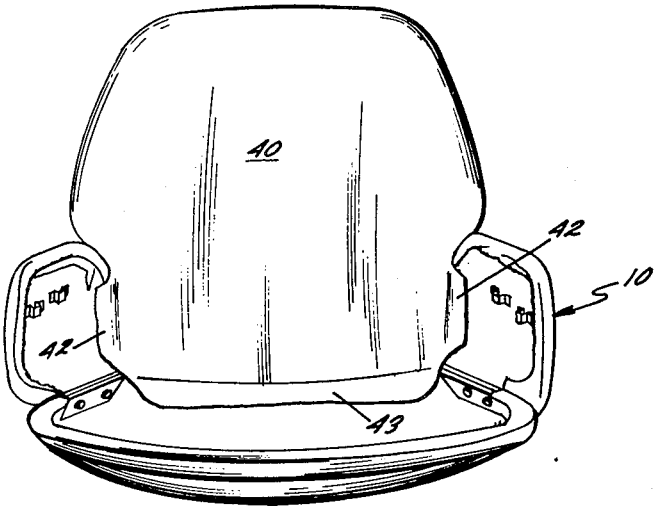
FIG. 7 is a front perspective view of the chair shell with the back cushion in place.

In assembling the chair, the molded segments of exterior supporting shell 10 are first upholstered by seamless upholstery segments 20. This is effected by gluing, stapling or the like. The segments are then joined together along their abutting flange portions 16 by nuts and bolts With supporting shell 10 thus assembled, back cushion 40 is joined to back shell segment 11 by hooking its books 70 into the hangers 71 mounted on back shell segment 11 (FIG. 7). Next, the arm cushions 50 are similarly mounted to arm shell segments 15, their sidewalls 52 overlapping and abutting side flanges 42 of back cushion 40 (FIG. 8). Finally, seat cushion 60 is lowered into position, its sidewalls 62 overlapping and abutting bottom flanges 53 of arm cushions 50 and its back wall 63 overlapping and abutting bottom flange 43 of back cushion 40. Bolts 75 are passed through the bottom of bottom shell segment 13 and are threaded into threaded apertures 65 in bottom cushion 60 to thereby positively hold all of the cushions in place (FIGS. 9 and 10).

ALTERNATIVE EMBODIMENT

FIGS. 13 through 18 show an alternative embodiment 2 of the invention. The basic differences between chair body 2 and chair body 1 arise from the fact that chair body 2 is molded from rigid urethane foam rather than glass fiber reinforced polyester resin. Because of the nature of rigid urethane foam, the various exterior shell segments of alternative embodiment chair 2 are thicker than their corresponding counterparts in chair body 1. Various rigid urethane foams are commercially available for use in the furniture industry and they have heretofore been used specifically in the construction of chairs.

To the extent that the components of chair body 2 are substantially identical in function to the components of chair body 1, they have been identified with the same last two digits as their corresponding counterparts in chair body 1, the two digits being preceded by the numeral 1. For example, the assembled exterior shell of chair body 2 has been designated 110 while the overall assembled exterior shell of chair body 1 bears the identification numeral 10.

Figure 13:
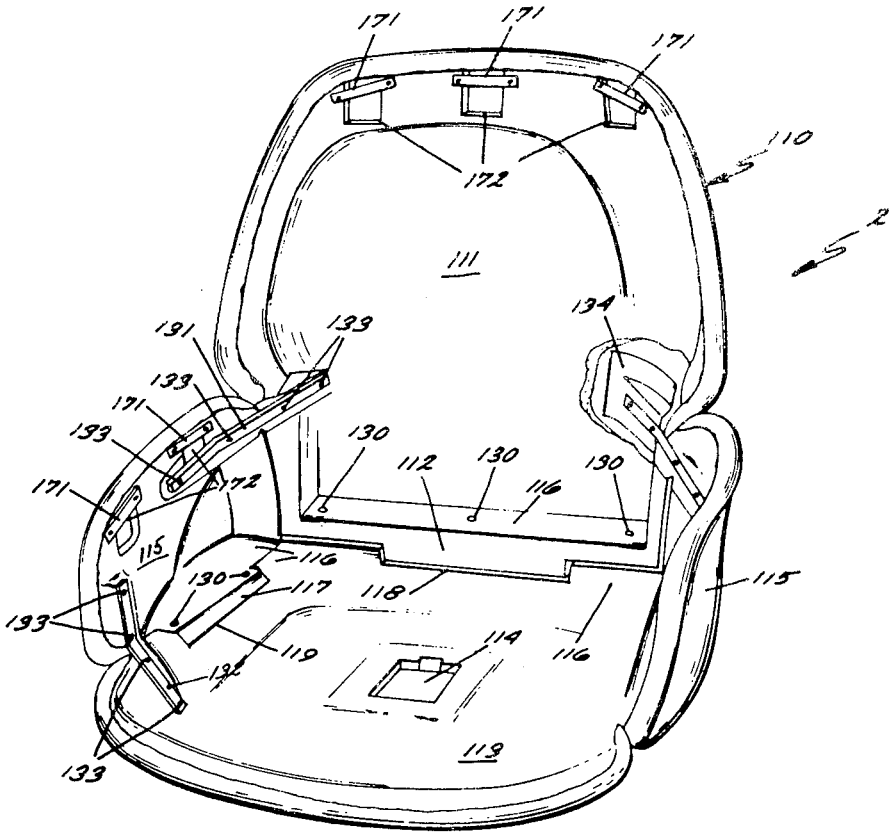
FIG. 13 is a front perspective view of an assembled alternative embodiment shell for the chair body.
Figure 14:
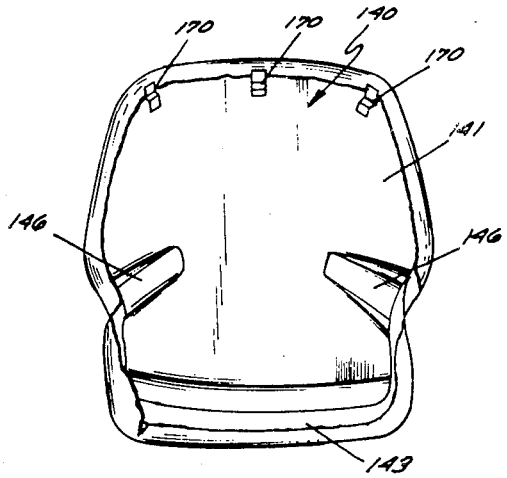
FIG. 14 is a rear elevational view of the back cushion of the alternative embodiment chair.
Figure 15:
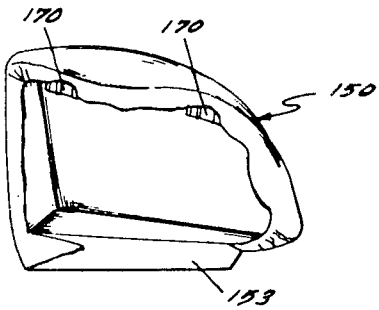
FIG. 15 is a rear elevational view of the arm cushion of the alternative embodiment chair.

In chair 1, the various exterior shell segments 11, 13 and 15 are joined by bolts passing through their respective peripheral inwardly turned flanges 16. While shell 111, 113 and 115 of shell 110 do not have inwardly turned flanges, they are molded to be of a generally dished configuration whereby peripheral flanges 116 are defined at least in areas where adjacent shell segments must be joined (FIG. 13). Bolts 130 pass from flange 116 in back segment 111 and arm segment 115 into a peripheral flange 116 in seat segment 113.

Chair 2 additionally employs a tongue and groove arrangement (FIG. 13). Back segment 111 includes a downwardly extending tongue 112 which fits into a receiving notch or groove 118 along the back edge of seat segment 113. The center bolt 130 holding back segment 111 extends specifically through flange 116 and behind tongue 112 and into seat segment 113. Similarly, each arm segment 115 includes a downwardly extending tongue 117 which fits into a notch or groove 119 along the side edge of seat shell segment 113.

In addition, each arm segment 115 is joined to back segment 111 by means of an arm-to-back joining bar 131 (FIG. 13). Bolts 133 extend through arm-to-back joining bar 131 and are threadably received in arm segment 115 and back segment 111. In order to provide a firm anchoring point for bolts 133 back segment 111 and arm segment 115, each include a steel reinforcing or anchoring plate 134 integrally molded into the rigid urethane foam. Suitable holes are prepunched into the embedded steel anchor plate 134 in order to receive bolts 133. In order to show one such embedded steel plate 134, a portion of the urethane foam in back segment 111 has been broken away.

Similarly, each are segment 115 is joined to to seat segment 113 by means of an arm-to-seat joining bar 132. Bolts 133 pass through holes in joining bar 132 and are anchored in embedded anchor plates such as anchor plate 134. As with arm-to-back joining bar 131, arm-to-seat joining bar 132 is bent so that it conforms somewhat to the inner contour of shell 110 and thereby extends readily from one shell segment to the other.

The hanger brackets 171 on back segment 111 and on arm segments 115 are somewhat different than hanger brackets 71 of shell 10. Back segment 111 and arm segments 115 are thicker than back segment 11 and arm segments 15, and they include integrally formed recesses 172 along their respective upper regions. Hangers 171 constitute flat pieces of steel bolted to back shell segment 111 or seat shel segment 115 as the case may be, across the various recesses 172. The various hooks 170 on back cushion 140 and arm cushion 150 fit into recesses 172 behind the hangers 171.

The back cushion 140 and arm cushion 150 of alternative embodiment chair 2 are constructed substantially similar to back cushion 40 and arm cushion 50 of chair 1. Indeed, the same material is used in both instances. The basic difference between back cushion 140 of chair 2 and back cushion 40 of chair 1 is that the pan 141 of back cushion 140 includes channel shaped recesses 146 therein in order to accommodate the arm-to-back joining bars 131. Channels 146 allow one to provide sufficient bulk, particularly in back segment 111, in the vincinity of arm-to-back joining bar 131 to give adequate strength to shell 110 in this area.

Another variation of only minor importance is that the hooks 170 for back cushion 140 are positioned closer to the top periphery of back cushion 140 than are the hooks 70 of back cushion 40. This insures a tighter fit of back cushion 140 against back shell segment 111 along the top periphery thereof. Also, the hooks 170 open upwardly instead of downwardly as do hooks 70 in first embodiment chair 1. Similarly, the hooks 170 of arm cushion 150 are positioned somewhat higher on arm cushion 150. Naturally, this also requires that the hangers 171 and recesses 172 on back shell segment 111 and arm shell segments 115 be located higher than the hangers 71 on back shell segment 11 and arm shell segments 15 of chair 1.

The seat cushion 60 of chair body 1 is adequate as already disclosed for use in chair 2 and therefore is not shown separately in conjunction with chair 2. The seat, back and arm cushions for chair 2 include the same cooperating flanges and surfaces as have been heretofore described in conjunction with chair 1 for purposes of holding the various back cushions within shell 110. One advantage to using rigid urethane as the construction material for shell 110, however, is that additional securing means can be employed as insurance. Back cushion 140 and arm cushions 150 can actually be bolted to back shell segment 111 and arm shell segments 115, respectively, along the bottom flanges 143 and 153 thereof, respectively. The rigid urethane shell segments 111 and 115 are sufficiently thick that one does not need to worry about the fastening screw coming through the exterior side of the shell. This provides an added margin of safety with respect to holding back cushion 140 and arm cushions 150 in place.

Figure 16:
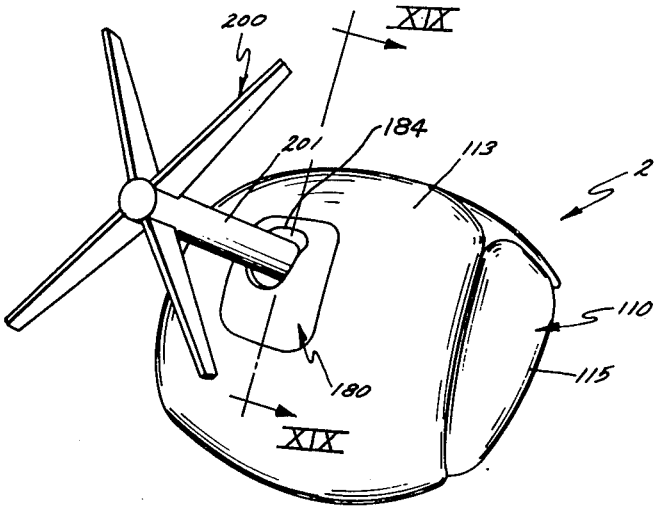
FIG. 16 is a fragmentary generally bottom perspective view of the alternative embodiment chair.
Figure 17:
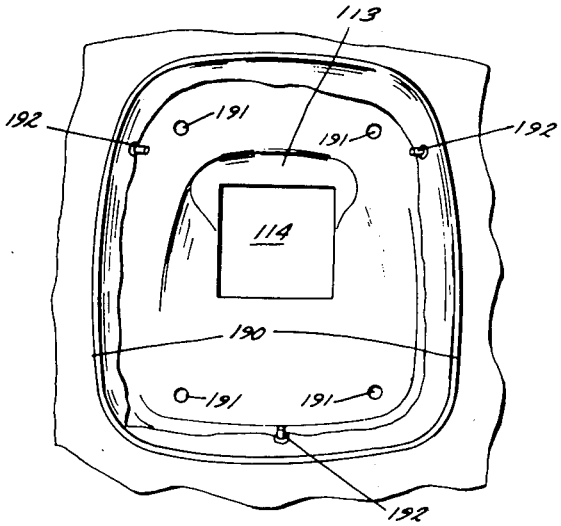
FIG. 17 is a fragmentary bottom plan view of the alternative embodiment chair.
Figure 18:
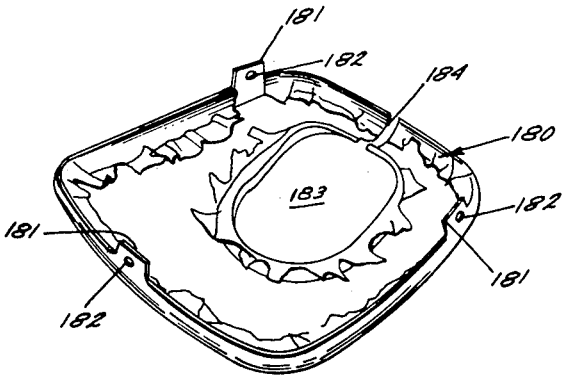
FIG. 18 is a generally perspective view of the cover piece for the bottom of the alternative embodiment chair, the cover piece being visible on the bottom of the chair as shown in FIG. 16.

FIGS. 16, 17 and 18 disclose a feature of chair 2 which can also readily be incorporated into alternative embodiment 1. A unique cover 180 is located on the bottom of shell 110 for the purpose of hiding the chair tilting control. Where no control is employed, the fastening of the chair base 200 to chair shell 110 is covered by cover 180. Seat segment 113 of chair shell 110 includes a recess 190 in the bottom exterior thereof (FIG. 17). Mounting holes 191 are provided for receiving bolts 75 which fasten a suitable base 200 to shell 110 (FIGS. 17 and 16). Recess 190 is sufficiently large to receive a chair tilt control in the event that one is desired. Because of recess 190, the chair control is recessed upwardly within shell 110 and is therby somewhat hidden from view. Cover 180 then further hides the chair control and indeed hides any fastening hardware from view.

Positioned on the side walls of recess 190 are three outwardly projecting pins 192. Two pins 192 are located at the sides and towards the rear of recess 190 while a third pin 192 is located at the front of recess 190. Cover 180 is molded of plastic or the like to a desired design configuration. It includes three upwardly projecting tabs 181, each including a hole 182 therein for cooperating with pins 192. One tab 181 is located at the front of cover 180, and the other two are located on the sides and generally at the rear of cover 180.

Cover 180 includes a large aperture 183 in the bottom thereof in order to accommodate the spindle or supporting post 201 of a chair supporting base 200. A slot 184 extends from the rear of aperture 183 through to the back edge of cover 180. Cover 180 should be made of a material which is somewhat flexible and resilient so that it can be separated at slot 184 a sufficient distance to allow one to slip cover 180 around spindle or post 201 of chair base 200. Then, with the chair base secured to shell 110 through suitable bolts in holes 191, one can move cover 180 upwardly and slip the hole 182 of front tab 181 over the front pin 192 in recess 190. Then, by compressing the rear portions of cover 180 slightly inwardly, one can fit each of the side tabs 181 over its respective side pin 192. In this manner, cover 180 is positively secured to the bottom of shell 110 and, for all practical purposes, completely seals any hardware or fastenings at the top of a chair base from view.

In the broader aspects of this feature of the invention, the slot 184 could be eliminated. In such a construction, cover 180 would have to be slipped over the post 201 of base 200 before any control or chair mounting plate were secured thereto. This would be somewhat clumsy during manufacturing however.

This aspect of alternative embodiment 2 can be as readily used with alternative embodiment 1. In alternative embodiment 2, the pins 192 can be embedded in the molded rigid urethan and thereby anchored in place. In alternative embodiment 1, some type of nut of bolt fastening would probably have to be used for pins 192.

CONCLUSION

The result of this invention is a chair which is both extremely attractive and reasonably economically manufacturable. The upholstered exterior of the contoured plastic shell guarantees and extremely rich, luxurious appearance. The designer is free to contour the appearance of this shell to suit his taste. He is free to provide for very pronounced lines of demarcation between adjacent shell segments or to render them almost invisible, depending on the aesthetic effect which he seeks to achieve. Economy is effected not only by ease of upholstering, but by the ease with which the various cushions are assembled to the structural shell.

Of course, it is understood that the above are merely preferred embodiments of the invention and that various changes and alterations can be made thereof without departing from the spirit and broader aspects of the invention.

The embodiments of the invention in which an exclusive property or privilege is claimed are defined as follows:

1. In a chair having a body mounted on a supporting base, said base including a supporting post, the improvement comprising: a plastic cover molded to a desired design configuration and secured to the bottom of said chair body and having dimensions sufficiently large for covering the upper portions of said supporting base but smaller than the dimensions of said bottom of said chair body, said cover having sufficient thickness to hold its said configuration independently of its securance to said chair body; said cover having an aperture therein through which said supporting post of said supporting base can pass; said cover including a slot extending from an edge of said aperture to the periphery of said cover, said slot being narrower in width than said supporting post and said cover being sufficiently flexible that it can be spread apart at said slot a sufficient distance to allow said cover to be slipped around said supporting post of said base during assembly of said chair; attachment means for securing said cover to said chair body.

2. The chair of claim 1 in which said chair body includes a recess in the bottom thereof into which the upper portions of said base extend; said cover having an upturned perimeter conforming generally to the shape of the perimeter of said recess whereby the upturned perimeter of said cover is positioned within said recess.

3. The chair of claim 2 in which said recess includes a plurality of spaced pins projecting from the side walls thereof; said cover including an upwardly projecting tab for each of said pins, each of said tabs including a hole therein for fitting over said pin.

4. In a chair having a body mounted on a supporting base, said base including a supporting post, the improvement comprising: a plastic cover molded to a desired design configuration and secured to the bottom of said chair body for covering the upper portions of said supporting base, said cover having sufficient thickness to hold its said configuration independently of its said securance to said bottom of said chair body; said cover having an aperture therein through which said supporting post of said supporting base can pass; said chair body including a recess in the bottom thereof into which the upper portions of said base extend; said cover having an upturned perimeter conforming generally to the shape of the perimeter of said recess whereby the upturned perimeter of said cover is positioned within said recess, said cover including means whereby said cover may be positioned around said post and within said recess, after said base has been assembled to said chair body.

* * * * *